US010699603B2

(12) United States Patent
Deco

(10) Patent No.: US 10,699,603 B2
(45) Date of Patent: Jun. 30, 2020

(54) APPARATUS FOR A TEXTILE TAG

(71) Applicant: Kerry Deco, Glendale, CA (US)

(72) Inventor: Kerry Deco, Glendale, CA (US)

( * ) Notice: Subject to any disclaimer, the term of this patent is extended or adjusted under 35 U.S.C. 154(b) by 55 days.

(21) Appl. No.: 16/185,255

(22) Filed: Nov. 9, 2018

(65) Prior Publication Data

US 2019/0213922 A1 Jul. 11, 2019

Related U.S. Application Data

(60) Provisional application No. 62/615,518, filed on Jan. 10, 2018.

(51) Int. Cl.

| | |
|---|---|
| ***G09F 3/02*** | (2006.01) |
| ***G09F 3/06*** | (2006.01) |
| ***D06F 55/00*** | (2006.01) |
| *A44B 99/00* | (2010.01) |

(52) U.S. Cl.

CPC ..... *G09F 3/06* (2013.01); *G09F 3/02* (2013.01); *A44B 99/00* (2013.01); *D06F 55/00* (2013.01); *G09F 2003/0282* (2013.01); *Y10S 24/91* (2013.01); *Y10S 493/961* (2013.01); *Y10T 24/205* (2015.01); *Y10T 24/44863* (2015.01); *Y10T 24/44906* (2015.01); *Y10T 24/44915* (2015.01); *Y10T 24/44932* (2015.01)

(58) Field of Classification Search

None

See application file for complete search history.

(56) References Cited

U.S. PATENT DOCUMENTS

| | | | | | |
|---|---|---|---|---|---|
| 176,292 | A | * | 4/1876 | Gardner | A41D 1/06 2/232 |
| D28,539 | S | * | 5/1898 | Ambler | D8/395 |
| 719,462 | A | * | 2/1903 | Gysling | A44B 99/00 24/559 |
| 1,392,119 | A | * | 9/1921 | Corbin | D06F 55/00 24/555 |
| 1,462,193 | A | * | 7/1923 | Cook | B42F 3/00 40/634 |
| 1,675,806 | A | * | 7/1928 | Holden | A45D 8/14 24/561 |
| 1,700,977 | A | * | 2/1929 | Butler | B42F 1/06 40/666 |
| 2,009,941 | A | * | 7/1935 | Mix | A44B 6/00 24/66.13 |

(Continued)

FOREIGN PATENT DOCUMENTS

| | | | | |
|---|---|---|---|---|
| CN | 201224263 Y | * | 4/2009 | B42F 1/06 |
| CN | 201693868 U | * | 1/2011 | |

(Continued)

*Primary Examiner* — Jeffrey A Vonch

(74) *Attorney, Agent, or Firm* — The Noblitt Group, PLLC

(57) ABSTRACT

An apparatus for a textile tag according to various aspects of the present technology include a removable tag that can be easily positioned along and removed from an end or edge portion of a towel to identify one towel from a plurality of identical or similar looking towels. The textile tag may be configured in various ways to aid in identification such as shape, color, and/or design. The textile tag may comprise a body having an open channel area configured to receive the end or edge portion of the towel and at least one gripping element configured to engage the towel to secure the textile tag in place.

20 Claims, 6 Drawing Sheets

(56) References Cited

U.S. PATENT DOCUMENTS 2,470,811 A * 5/1949 Engleman ..... A47K 10/12 40/658
2,478,376 A * 8/1949 De Swart ..... B42F 1/10 24/67.9
2,614,305 A * 10/1952 Yeardley ..... A45F 5/022 24/3.8
2,629,916 A * 2/1953 Footlick ..... B65D 33/30 24/561
2,729,868 A * 1/1956 Manning ..... A45C 1/06 24/545
2,960,742 A * 11/1960 Solomon ..... A44B 99/00 24/561
3,119,163 A * 1/1964 Merfeld ..... A44B 6/00 24/562
3,214,813 A * 11/1965 Goldman ..... D06F 55/00 24/562
3,309,052 A * 3/1967 Borisof ..... F16L 3/13 248/205.3
3,381,883 A * 5/1968 Harris ..... B65D 5/069 229/125.19
D218,511 S * 8/1970 Sarro ..... D19/34
3,600,764 A * 8/1971 Froehlich ..... A47L 13/512 24/545
3,754,307 A * 8/1973 Froehlich, Jr. ..... A44B 99/00 24/555
3,766,613 A * 10/1973 Merfeld ..... A44B 99/00 24/561
3,797,076 A * 3/1974 Watkin ..... A44B 99/00 24/562
3,962,758 A * 6/1976 Knappe ..... B65D 85/182 24/562
4,011,639 A * 3/1977 Koleske ..... A45D 8/24 24/561
4,011,673 A * 3/1977 Levine ..... G09F 3/16 40/641
4,194,274 A * 3/1980 Garrison ..... A47G 25/485 223/91
D286,014 S * 10/1986 Davis ..... D8/395
4,706,342 A * 11/1987 Yu ..... B42F 1/02 24/545
4,793,030 A * 12/1988 Hirsch ..... A44C 5/16 24/265 WS
D302,242 S * 7/1989 Belash ..... D8/395
4,871,097 A * 10/1989 Blanchard ..... A47G 25/48 223/85
D307,218 S * 4/1990 Arnold ..... D32/64
4,947,524 A * 8/1990 Chang ..... B42F 1/04 24/563
4,991,269 A * 2/1991 Kuroda ..... B42F 1/02 24/545
4,993,126 A * 2/1991 Collins ..... A47C 21/022 211/124
D315,675 S * 3/1991 Kennedy ..... D32/64
5,113,554 A * 5/1992 Gallo ..... A47G 25/485 223/88
5,136,754 A * 8/1992 Kuroda ..... B42F 1/02 24/67.9
5,159,730 A * 11/1992 Radvin ..... A44B 99/00 24/543
D334,411 S * 3/1993 Kuroda ..... D19/65
5,309,605 A * 5/1994 Sato ..... B42F 1/06 24/563
5,398,384 A * 3/1995 Rinard ..... B42F 1/06 24/67 R
5,692,806 A * 12/1997 Jones ..... B60R 22/19 24/561
D453,294 S * 2/2002 Bitzer ..... D8/395
6,405,415 B1 * 6/2002 Meeks ..... A44B 99/00 24/350
6,457,218 B1 * 10/2002 Lawrence ..... B42F 1/10 24/3.12
D492,351 S * 6/2004 Sato ..... D19/34
7,237,306 B1 * 7/2007 Flowers ..... A41F 17/02 24/564
D566,537 S * 4/2008 Wen-Po ..... D8/395
D581,311 S * 11/2008 Cornett ..... D11/78.1
D619,451 S * 7/2010 Carlesso ..... D16/237
D623,048 S * 9/2010 Moy ..... A47K 10/14 D8/395
7,963,010 B2 * 6/2011 Levesque ..... A44B 99/00 24/3.1
D688,586 S * 8/2013 Diehl ..... D11/78.1
D715,631 S * 10/2014 Szymanski ..... D8/395
D716,183 S * 10/2014 Crooks ..... D11/215
D740,111 S * 10/2015 Espinoza ..... D8/395
D743,245 S * 11/2015 Roeters ..... D8/395
D751,890 S * 3/2016 Dubble ..... D8/395
D752,966 S * 4/2016 Katz ..... D8/395
D752,967 S * 4/2016 Katz ..... D8/395
D757,533 S * 5/2016 Ormsbee ..... D8/395
D794,437 S * 8/2017 Zinser ..... D8/395
D796,945 S * 9/2017 Stokeley ..... D8/395
D829,541 S * 10/2018 Montgomery ..... D8/395
D832,093 S * 10/2018 Ksiazek ..... D8/395
D832,693 S * 11/2018 Ksiazek ..... D8/395
2002/0083632 A1 * 7/2002 Hyde ..... G09F 3/207 40/666
2003/0056344 A1 * 3/2003 Brogdon, III ..... D06F 55/00 24/564
2003/0101551 A1 * 6/2003 Levesque ..... A44B 99/00 24/545
2005/0066488 A1 * 3/2005 Brogdon ..... D06F 55/00 24/564
2006/0010661 A1 * 1/2006 Murphy ..... A41F 17/02 24/545
2007/0283609 A1 * 12/2007 Chamandy ..... G09F 3/20 40/658
2008/0072403 A1 * 3/2008 Peck ..... B42F 1/02 24/67.9
2008/0289159 A1 * 11/2008 Solich ..... D06F 55/00 24/571
2009/0217558 A1 * 9/2009 Maier-Hunke ..... G09F 3/207 40/1.6
2010/0005693 A1 * 1/2010 Craycroft ..... G09F 3/207 40/360
2010/0088863 A1 * 4/2010 Moy ..... A47K 10/14 24/459
2011/0203035 A1 * 8/2011 Kim ..... A41F 19/005 2/255
2012/0042551 A1 * 2/2012 Manchin ..... G09F 3/08 40/666
2012/0227238 A1 * 9/2012 Manchin ..... G09F 3/16 29/428
2014/0013551 A1 * 1/2014 Thomson ..... A45C 1/06 24/499
2014/0250640 A1 * 9/2014 Crooks ..... A41F 19/00 24/303
2015/0157098 A1 * 6/2015 Stubblefield ..... G09F 23/00 24/556
2017/0303614 A1 * 10/2017 McMahon ..... D06F 55/00

FOREIGN PATENT DOCUMENTS

DE 381810 C * 9/1923 ..... B42F 1/06
DE 9204429 U1 * 6/1992 ..... B42F 9/008
DE 9400573 U1 * 5/1994 ..... B42F 1/06
DE 4426279 A1 * 2/1996 ..... B65D 35/28
DE 20108410 U1 * 8/2001 ..... B42F 1/04
ES 1077076 U * 5/2012
GB 157520 A * 1/1921 ..... B42F 1/06
GB 533004 A * 2/1941 ..... G09F 3/06
GB 2362918 A * 12/2001 ..... A44B 99/00
JP 55012818 U * 1/1980
JP 2006122226 A * 5/2006 ..... B42F 1/06
JP 2007021917 A * 2/2007
JP 2008173425 A * 7/2008
JP 2010057699 A * 3/2010 ..... B42F 1/06
KR 200421952 Y1 * 7/2006 ..... G09F 3/06
KR 20110027271 A * 3/2011

(56) References Cited

FOREIGN PATENT DOCUMENTS

| | | | | | |
|---|---|---|---|---|---|
| NL | 1020466 | C1 | * | 10/2003 | ..... B42F 1/06 |
| WO | WO-0158700 | A1 | * | 8/2001 | ..... B42F 1/06 |
| WO | WO-2017200157 | A1 | * | 11/2017 | ..... B42F 1/02 |

* cited by examiner

APPARATUS FOR A TEXTILE TAG

CROSS-REFERENCES TO RELATED APPLICATIONS

This application claims the benefit of U.S. Provisional Patent Application No. 62/615,518, filed Jan. 10, 2018, and incorporates the disclosure of the application by reference.

BACKGROUND OF THE TECHNOLOGY

In multi-person households, bathrooms are often shared between persons. The typical bathroom may have only a single or possible two towel racks limiting where towels can be hung. Other options for hanging towels often include items such as hooks hung from a wall or the bathroom door. For aesthetic reasons, bathroom towels are often the same color. The combination of limited hanging space and use of the same color towels may create confusion amongst people sharing the same bathroom and lead to one or more persons not knowing which towel is "theirs." Similarly, kitchen towels are often identical to one another, but may be used for different purposes such as drying dishes and glassware or drying hands.

SUMMARY OF THE TECHNOLOGY

An apparatus for a textile tag according to various aspects of the present technology include a removable tag that can be easily positioned along and removed from an end or edge portion of a towel to identify one towel from a plurality of identical or similar looking towels. The textile tag may be configured in various ways to aid in identification such as shape, color, and/or design. The textile tag may comprise a body having an open channel area configured to receive the end or edge portion of the towel and at least one gripping element configured to engage the towel to secure the textile tag in place.

BRIEF DESCRIPTION OF THE DRAWINGS

A more complete understanding of the present technology may be derived by referring to the detailed description and claims when considered in connection with the following illustrative figures. In the following figures, like reference numbers refer to similar elements and steps throughout the figures.

Figure 1:
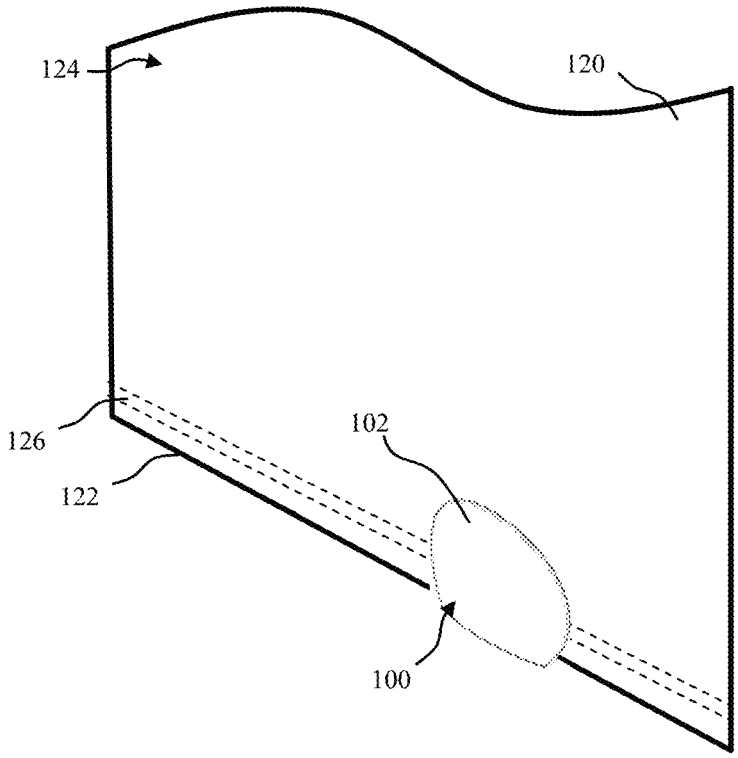
FIG. 1 representatively illustrates a front view of a textile tag coupled to a towel in accordance with an exemplary embodiment of the present technology.
Figure 2:
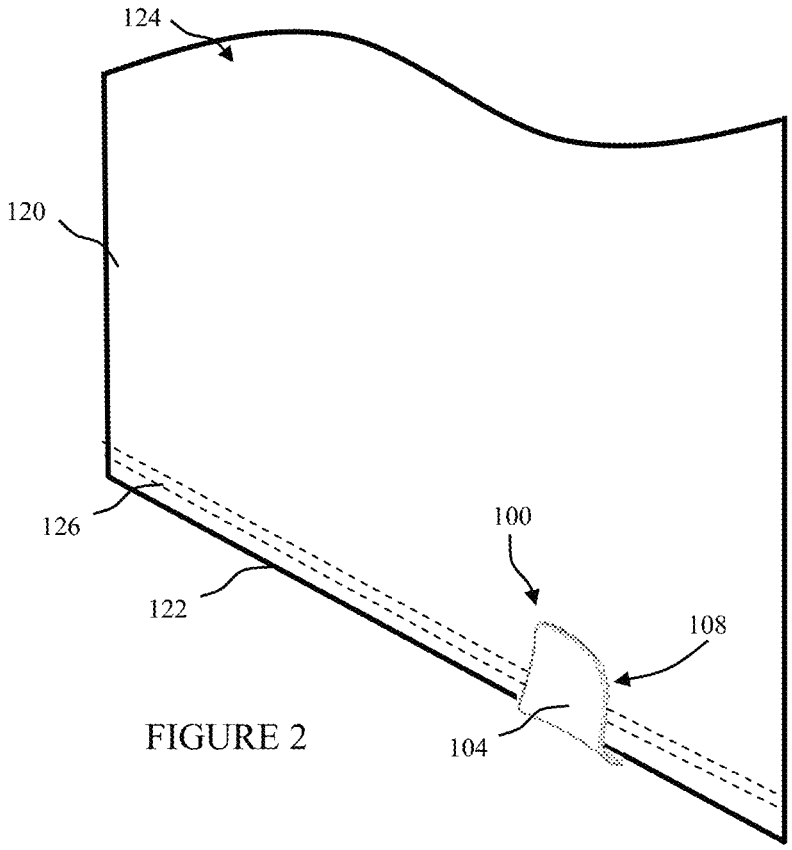
FIG. 2 representatively illustrates a rear view of the textile tag coupled to the towel in accordance with an exemplary embodiment of the present technology.

Elements and steps in the figures are illustrated for simplicity and clarity and have not necessarily been rendered according to any particular sequence. For example, steps that may be performed concurrently or in a different order are illustrated in the figures to help to improve understanding of embodiments of the present technology.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various materials, coupling mechanisms, dimensions, and geometries, which may carry out a variety of operations suited to a selective attachment to a textile. In addition, the technology described is merely one exemplary application for the disclosed device. Further, the present technology may employ any number of conventional techniques for securing one device to another.

Methods and apparatus for a textile tag according to various aspects of the present technology may operate in conjunction with any textile, fabric, or material such as cotton or polyester used to form an article such as a towel or garment. Various representative implementations of the present technology may be applied to any type of towel or garment to help identify otherwise identical looking towels or garments from each other. For example, two identical bath towels may hang next to each other and have no distinguishing elements or features that may be used to identify one towel from the other. This may cause a user of one of the towels to be unable to identify which towel is being used by them and which towel is being used by another. The problem of properly identifying one's towel from another is exacerbated even further when three or more people are sharing a bathroom and all of the available towels are identical.

Referring to FIGS. 1-9, a textile tag 100 may comprise a body comprising a front member 102 and an opposing rear member 104 that are separated, at least in part, by an open channel area 106. A gripping element 108 may extend inward into the open channel area 106 from at least one of front and rear members 102, 104 and be suitably configured to help removably couple the textile tag 100 to a towel 120.

The body of the textile tag 100 may comprise a semi-flexible material such as plastic that may allow the width of the open channel area 106 to vary slightly by allowing the front member 102 and the rear member 104 to flex apart from each other to accommodate varying towel thicknesses and/or during use when the towel 120 and textile tag 100 are coupled together. This flexing ability may also facilitate secure attachment of the textile tag 100 to the towel 120 by creating a compressive force that causes the gripping element 108 to press into the fabric of the towel 120.

In use, the textile tag 100 may be selectively coupled or attached to a first end 122 of the towel 120 to help distinguish the towel 120 from a second otherwise identical looking towel. The front member 102 is intended to be positioned on an outwardly facing surface of the towel 120 so that the front member 102 is readily visible to a viewer, such as when the towel is hanging from a towel bar (not shown). The front member 102 may comprise any suitable device to help aid identification such as a surface treatment, decoration, or attachable decorative device to help distinguish one textile tag 100 attached to a first towel from a second textile tag 100 attached to a second towel. For example, in a first embodiment, a forward facing side of the front member 102 of a first textile tag 100 may be colored red and a forward facing side of the front member 102 of a second textile tag 100 may be colored blue. Accordingly, when each textile tag 100 is coupled to a towel 120, each towel 120 will be identifiable from the other by the two different textiles tags 100 even if the towels 120 are otherwise indistinguishable from one another. The textile tag 100 may be easily removed from the towel 120 whenever desired, such as when the towel 120 is laundered.

In an alternative embodiment, the forward facing side of the front member 102 may be configured to be selectively modified to help identify the textile tag 100. For example, the forward facing side of the front member 102 may comprise a dry-erase surface or other similar non-permanent writing surface that can be selectively written on by a user, such as to write a name, number, or other note that can be used to identify the towel 120 the textile tag 100 is attached to. In yet another embodiment, at least a portion of the forward facing side of the front member 102 may comprise a metallic surface. In this embodiment, an element having a magnet may be selectively attached to the forward facing side of the front member 102 to distinguish one textile tag 100 from another.

The front member 102 may comprise any suitable shape or size and extend along a surface of the towel 120 from the first end 122 towards a middle portion 124 of the towel 120. For example, in one embodiment, the front member 102 may comprise a height of between about one-half of an inch (12.7 mm) and about four inches (101.6 mm). Similarly, the rear member 104 may comprise any suitable shape or size. The front and rear members 102, 104 may comprise roughly equal sizes or the front member 102 may comprise a height greater than that of the rear member 104.

The front member 102 may also be configured in a manner to aid identification. In one embodiment, the front member 102 may be formed in an ornamental shape or design. For example, the front member 102 may be configured in any desired shape such as a vehicle, animal, cartoon or movie character, or the like to allow for a more personalized method of allowing a user to more quickly and easily identify their towel 120 from another towel 120.

Figure 3:
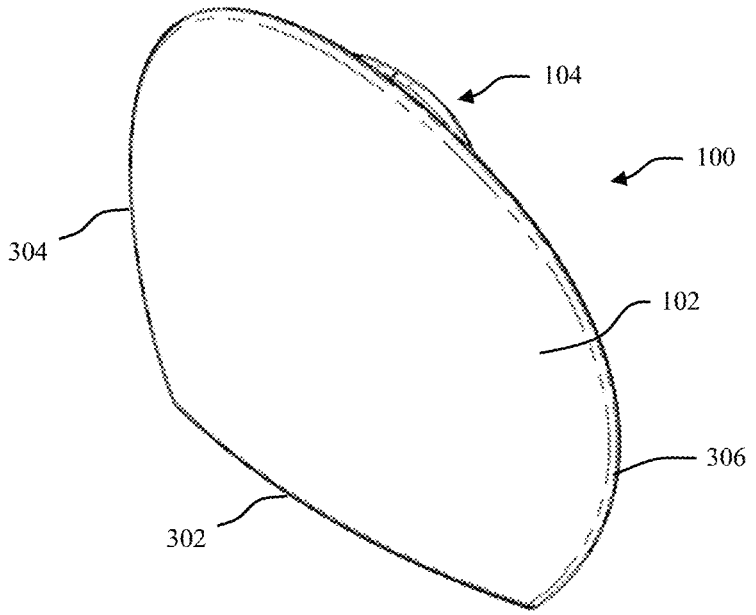
FIG. 3 representatively illustrates a perspective front view of the textile tag accordance with an exemplary embodiment of the present technology.
Figure 4:
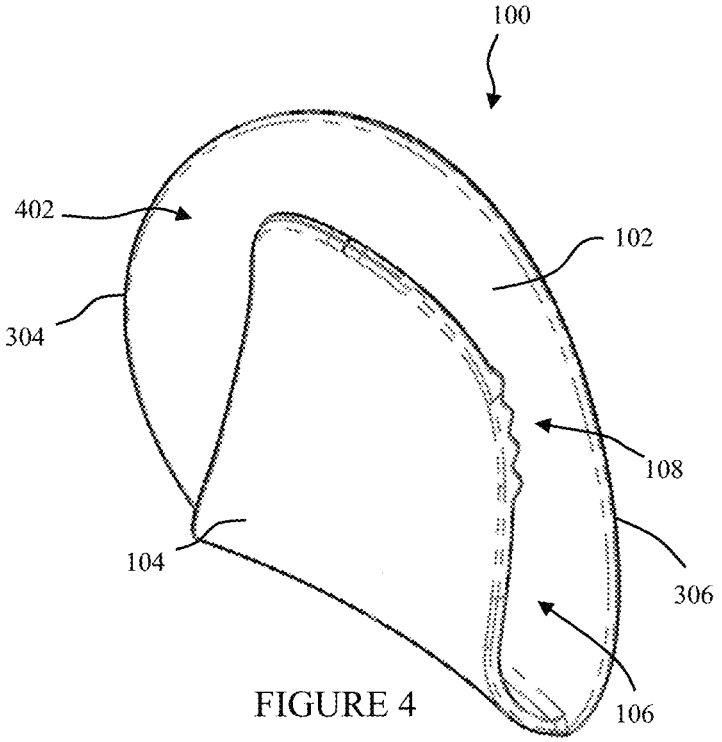
FIG. 4 representatively illustrates a perspective rear view of the textile tag accordance with an exemplary embodiment of the present technology.
Figure 5:
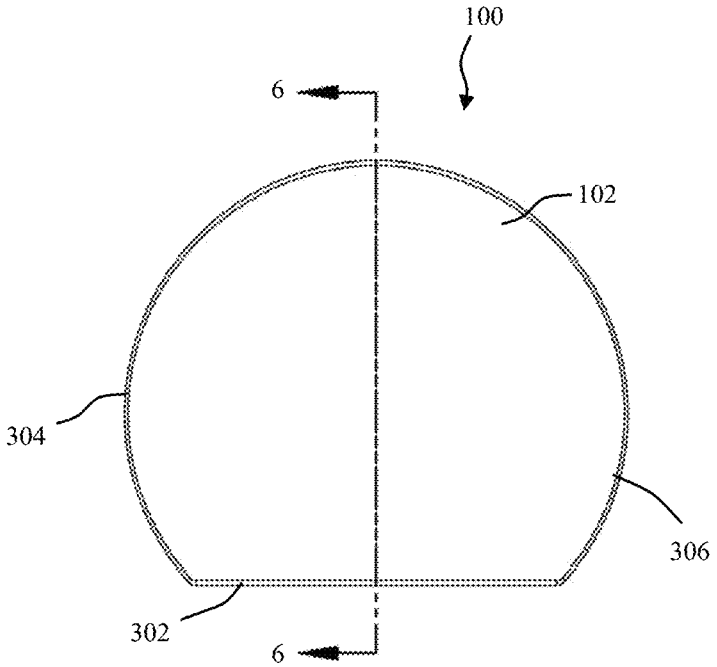
FIG. 5 representatively illustrates a front view of the textile tag in accordance with an exemplary embodiment of the present technology.
Figure 6:
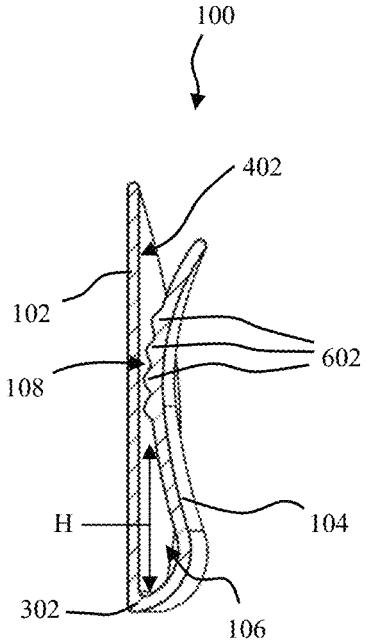
FIG. 6 representatively illustrates a cross-section view across line 6-6 of FIG. 5 in accordance with an exemplary embodiment of the present technology.
Figure 7:
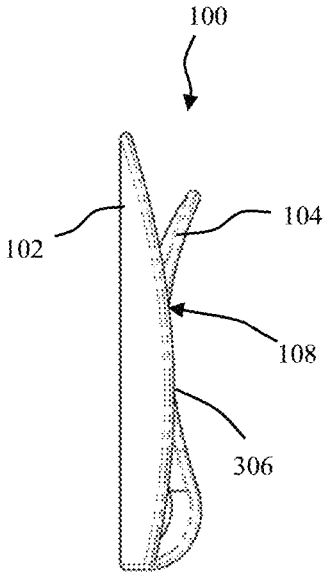
FIG. 7 representatively illustrates a side view of the textile tag in accordance with an exemplary embodiment of the present technology.
Figure 8:
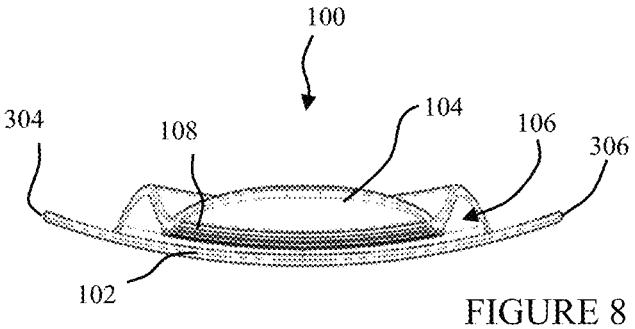
FIG. 8 representatively illustrates a top view of the textile tag in accordance with an exemplary embodiment of the present technology.
Figure 9:
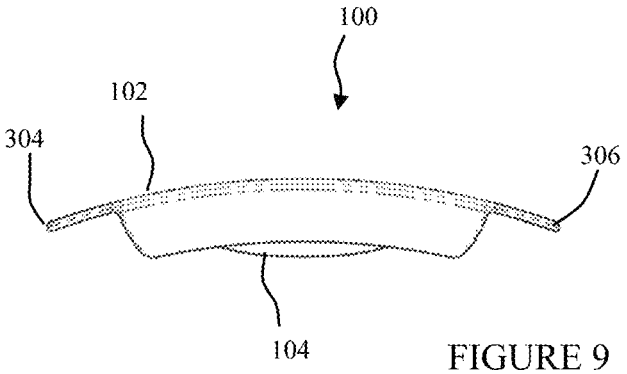
FIG. 9 representatively illustrates a bottom view of the textile tag in accordance with an exemplary embodiment of the present technology.
Figure 10A:
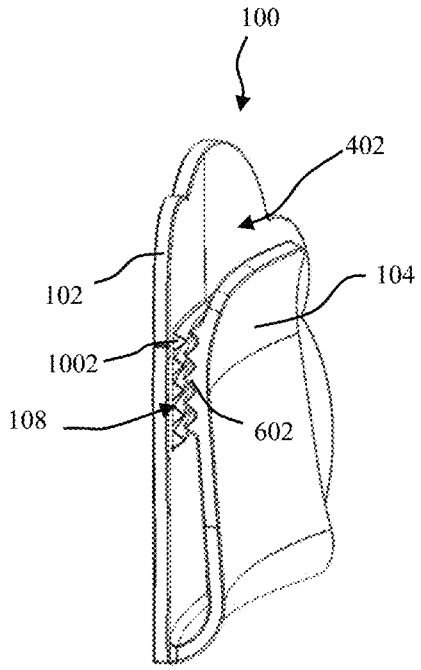
FIG. 10A representatively illustrates a rear perspective view of the textile tag having an alternative coupling element in accordance with an exemplary embodiment of the present technology.
Figure 10B:
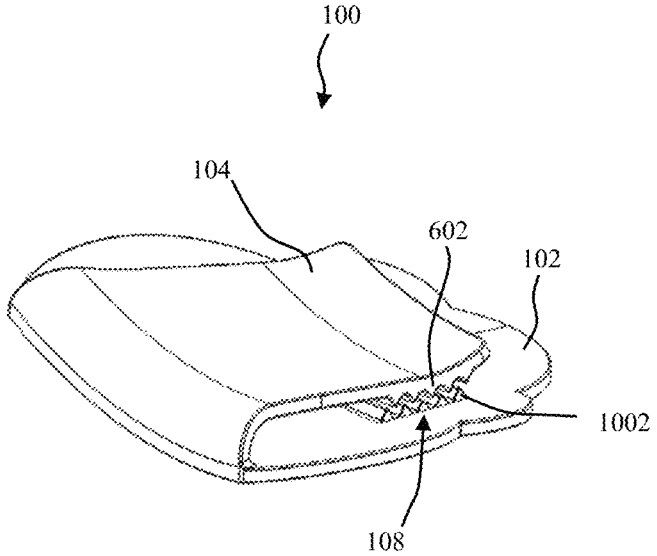
FIG. 10B representatively illustrates an alternative view of the embodiment shown in FIG. 10A.
Figure 11A:
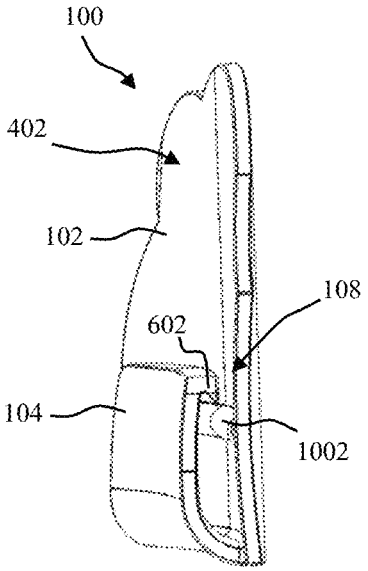
FIG. 11A representatively illustrates a rear perspective view of the textile tag having a second alternative coupling element in accordance with an exemplary embodiment of the present technology.
Figure 11B:
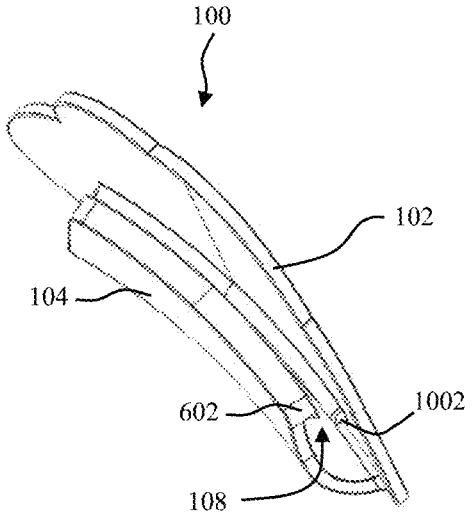
FIG. 11B representatively illustrates an alternative view of the embodiment shown in FIG. 11B.

Referring now to FIGS. 1, 3, and 5, in one embodiment, the front member 102 may comprise a generally half bivalve shell (clamshell) shape having a relatively straight edged bottom portion 302 with opposing side edges 304, 306 that curve upwardly from the bottom portion 302 towards each other at a central upper portion of the body. Alternatively, or in addition to, and referring now to FIGS. 7-9, the body of the front member 102 may comprise an arcuate shape such that the opposing side edges 304, 306 extend rearward from a mid-point of the body. For example, the opposing side edges 304, 306 may extend rearward to the point of being aligned with or positioned behind the gripping element 108. The rearward extending arcuate shape may allow the textile tag 100 to form a higher degree of hold to the towel 120 due to increased friction when the textile tag 100 is coupled to the towel 120.

Figure 12:
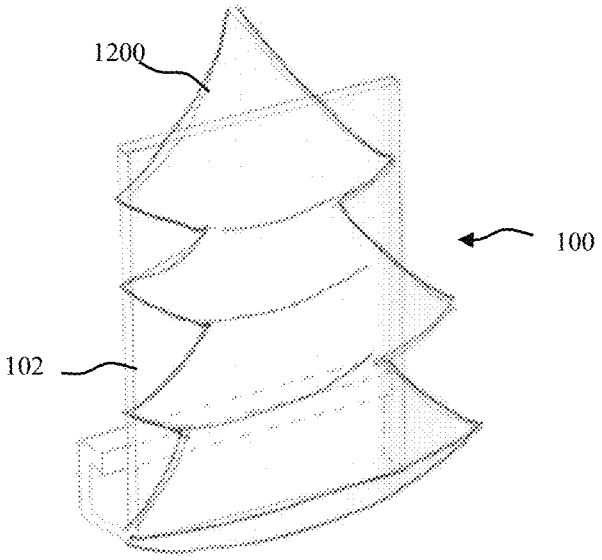
FIG. 12 representatively illustrates the textile tag having a decorative design in accordance with an exemplary embodiment of the present technology.

Referring now to FIG. 12, in an alternative embodiment, the front member 102 may comprise a decorative shape. For example, a decorative element 1200 may be affixed to the forward facing side of the front member 102. The decorative element 1200 may be permanently affixed to the front member 102 or the decorative element 1200 and the front member 102 may be configured to allow the decorative element 1200 to be selectively attached and removed to facilitate the attachment of various types of decorative elements to the front member 102 allowing for more customization of the textile tag 100. For example, in one embodiment, the decorative element 1200 may comprise a Christmas tree shaped figure that might be used during the holidays to allow the textile tag 100 to not only allow a user to easily distinguish a given towel 120 from another towel 120 but to also provide a seasonally appropriate decoration. The decorative element 1200 may then be removed from the front member 102 after the holiday and replaced with a second decorative element (not shown) that is representative of a different holiday, such as Valentine's Day, Easter, Thanksgiving, or any other desired design.

The decorative element 1200 may be connected by any suitable method or device allowing for the selective attachment and detachment of the decorative element 1200 to the forward facing side of the front member 102. For example, in one embodiment the decorative element 1200 and the forward facing side of the front member 102 may be configured to be coupled together magnetically. In an alternative embodiment, a device such as a hook and loop fastening system may be used to selectively couple the decorative element 1200 and the forward facing side of the front member 102 together. In yet another embodiment, the decorative element 1200 and the forward facing side of the front member 102 may be configured with a mating mechanical attachment system.

Figure 13:
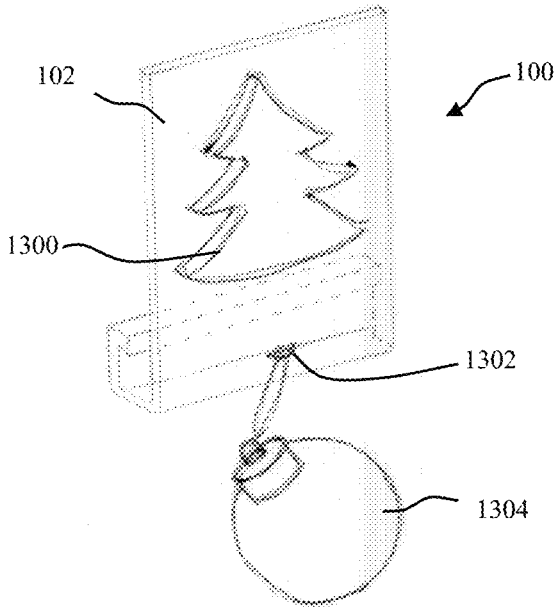
FIG. 13 representatively illustrates the textile tag with a connection mechanism in accordance with an exemplary embodiment of the present technology.
Figure 14A:
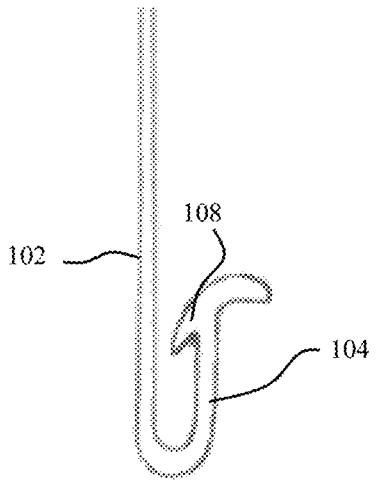
FIG. 14A representatively illustrates an alternative coupling element in accordance with an exemplary embodiment of the present technology.
Figure 14B:
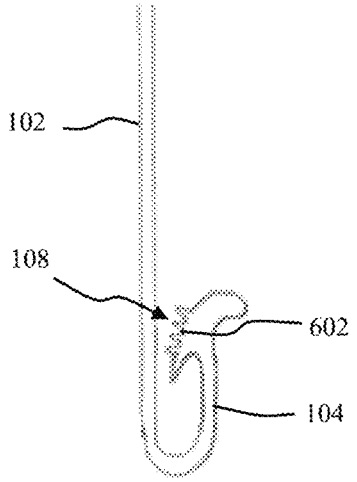
FIG. 14B representatively illustrates an alternative coupling element in accordance with an exemplary embodiment of the present technology.
Figure 14C:
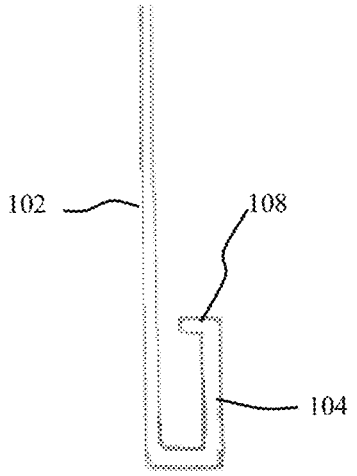
FIG. 14C representatively illustrates an alternative coupling element in accordance with an exemplary embodiment of the present technology.
Figure 14D:
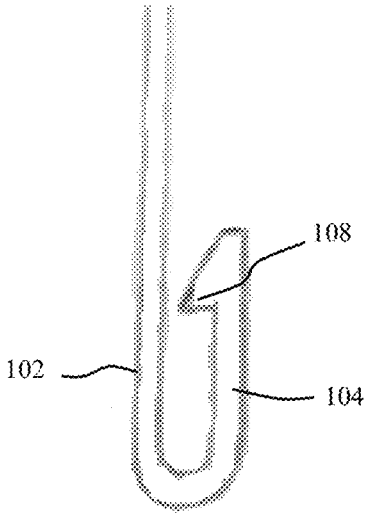
FIG. 14D representatively illustrates an alternative coupling element in accordance with an exemplary embodiment of the present technology.

Referring now to FIG. 13, the textile tag 100 may further comprise an attachment mechanism configured to allow for the attachment of more traditional decorations. For example, a ring 1302 may be positioned along a lower surface of the body of the textile tag 100 to allow a decoration 1304 to be connected to the textile tag 100. The forward facing side of the front member 102 may also comprise a design element 1300 similar to that described above with respect to FIG. 12.

Rear

The rear member 104 extends upwardly from the bottom portion 302 of the front member 102 and along a rear facing side 402 of the front member 102. At least a portion of the rear member 104 may be separated from the front member 102 by the open channel area 106. In one embodiment, and referring now to FIGS. 2, 4, 6-8, 10A, and 10B, the rear member 104 may form a compound curve having a lower portion that initially curves upwardly away from the bottom portion 302 of the front member 102, a middle portion that curves back towards a middle section of the rear facing side 402 of the front member 102, and an upper portion that curves away from the rear facing side 402 of the front member 102.

The open channel area 106 may be formed from the space created in the region or gap between the front member 102 and the lower portion of the rear member 104 and be suitably sized to receive the first end 122 of the towel 120. For example, a width of the open channel area 106 separating the front member 102 from the rear member 104 may be determined according to any suitable criteria, such as the approximate average thickness of standard bathroom towels, beach towels, kitchen towels, or the like.

The upper portion of the rear member 104 may be configured to aid in allowing the first end 122 of the towel 120 to be inserted between the front and rear member 102, 104 and down into the open channel area 106. For example, the curve of the upper portion of the rear member 104 away from the front member 102 may create an insertion region where the first end 122 of the towel 120 can be slid between the front and rear member 102, 104. Alternatively, the upper portion of the rear member 104 may be configured to allow a user to apply pressure to the upper portion of the rear member 104 to separate or flex the middle portion of the rear member 104 away from the rear facing side 402 of the front member 102 to create an opening that the towel 120 can be inserted into.

Gripping Element

The gripping element 108 may be used to help the textile tag 100 hang in an inverted fashion from the towel 120 without slipping, sagging, or otherwise disengaging from the towel 120. The gripping element 108 may comprise any suitable device or system for increasing the ability of the textile tag 100 to remain coupled to the towel 120.

The gripping element 108 may be configured to prevent damage to the fibers of the towel 120 when the textile tag 100 is connected to the towel 120. For example, most towels are formed of looped fabric to help with the absorption fluid. Damaging or cutting this looped fabric reduces the structural integrity of the textile weave. Accordingly, the gripping element 108 may be formed to avoid sharp edges and/or not provide too much "grip" between the textile tag 100 and the towel 120 that might damage the fabric of the towel 120. The gripping element 1008 may also be flexible or semi-rigid to further reduce a likelihood of damaging the fabric.

The gripping element 108 may comprise any suitable size or shape that allows for engagement between the gripping element 108 and the towel 120 without damaging the looped fabric 306. For example, in one embodiment, the gripping element 108 may be configured to allow the textile tag 100 to be slid onto the towel 120 along an edge portion of the towel at the first end 122.

The gripping element 108 may also be configured to reduce the likelihood of the textile tag 100 sliding in an undesired direction. For example, referring now to FIGS. 6, 10A, 10B, and 14B, the gripping element 108 may comprise one or more grippers 602 positioned along a surface of the gripping element 108 that are intended to engage the surface of the towel 120. The grippers 602 may allow the textile tag 100 to slide along the towel 120 in a generally horizontal (edge-to-edge) direction so that the textile tag 100 may be properly positioned while impeding the ability of the textile tag 100 to slide in the vertical (end-to-end) direction that might cause the textile tag 100 to slide off the first end 122 of the towel 120. For example, the grippers 602 may comprise a series of horizontally aligned ridges configured to increase an amount of friction between the textile tag 100 and the towel 120 when the relative movement of the towel 120 to the textile tag 100 is perpendicular to the ridges.

The gripping element 108 may be disposed along an inward facing surface of rear member 104 and/or the rear facing side 402 of the front member 102. For example and referring again to FIGS. 2, 4, 6, and 8, in one embodiment the gripping element 108 may be disposed along the middle portion of the rear member 104 and extend outwardly towards the rear facing side 402 of the front member 102. The gripping element 108 may be positioned at a predetermined height H above a lower surface of the open channel area 106 to allow the first end 122 of the towel 120 to be received within the open channel area 106. The height H may be determined according to any suitable criteria such as to accommodate a desired length of the first end 122 of the towel 120. For example, the height H may comprise at least approximately one inch to approximately 1.5 inches (25.4-38.1 mm).

In an alternative embodiment, and referring now to FIGS. 11A, 11B, and 14A-14D, the rear member 104 may comprise a lower portion that initially curves upwardly away from the bottom portion of the front member 102 and then continues upward generally parallel to the rear facing side 402 of the front member 102. In this embodiment, the gripping element 108 may be disposed at a top edge of the rear member 104 and may utilize the hem 126 of the towel 120 as a guide for the gripping element 108 allowing for both secure attachment and a surface along which the gripping element 108 may slide allowing the textile tag 100 be positioned anywhere along a width of the towel 120. For example, the gripping element 108 may be positioned at a height selected to engage the hem 126 along the first end 122 of the towel 120. In addition, the gripping element 108 may be oriented such that the outwardly extending portion is configured to use the hem 126 to increase the holding power between the textile tag 100 and the towel 120.

Referring now to FIGS. 10A, 10B, 11A, and 11B, the gripping element 108 may alternatively or additionally be positioned on the rear facing side 402 of the front member 102 and extend towards the rear member 104. The addition of a second gripping element 1002 to the rear facing surface of the front member 102 may provide for increased surface contact making it less likely that the textile tag 100 is inadvertently removed from the towel 120. For example, including a second gripping element 1002 may provide the textile tag 100 with increased holding capability for thinner towels 120 that do not have very plush fabrics or incorporate thinner fabrics such as tea towels and wash cloths.

These and other embodiments for methods of creating a removable identification tag for a textile may incorporate concepts, embodiments, and configurations as described above. The particular implementations shown and described are illustrative of the technology and its best mode and are not intended to otherwise limit the scope of the present technology in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the components and/or elements recited in any apparatus embodiment may be assembled or otherwise operationally configured in a variety of permutations to produce substantially the same result as the present technology and are accordingly not limited to the specific configuration recited in the specific examples.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology, as expressed in the following claims.

The invention claimed is:

1. A removable tag for a towel, comprising:

an arcuately shaped front member having a forward facing side and a rear facing side, wherein:

the arcuately shaped front member extends vertically upwards from a bottom edge to form a substantially flat surface in the vertical direction;

a first side edge and a second side edge of the arcuately shaped front member extend rearward to form a concave surface relative to the rear facing side, and the bottom edge curves rearward along a same arc path formed by the concave surface;

a rear member extending upwards from the bottom edge of the arcuately shaped front member adjacent the rear facing side, wherein:

the rear member comprises a series of protruding rides disposed along a surface of the rear member facing the rear facing side of the arcuately shaped front member and aligned parallel to a direction of curvature of the concave surface, wherein the first side edge and the second side edge of the arcuately shaped front member extend rearward of the series of protruding ridges; and an open channel area is formed below the gripping element and above the bottom edge between a lower portion of the rear facing side of the arcuately shaped front member, and a lower portion of the surface of the rear member facing the rear facing side.

2. The removable tag of claim 1, wherein the arcuately shaped front member comprises a series of protruding ridges disposed along the rear facing side, aligned parallel to the direction of curvature of the concave surface, and positioned proximate to the series of protruding ridges of the rear member such that protruding ridges are corresponding and offset.

3. The removable tag of claim 1, wherein the rear member further comprises an upper portion disposed above the series of protruding ridges.

4. The removable tag of claim 3, wherein the rear member comprises a curved shape relative to the arcuately shaped front member such that the surface facing the rear facing side of the arcuately shaped front member forms a curving surface, wherein:

a direction of curvature of the curving surface is perpendicular to the direction of curvature of the concave surface;

a middle portion of the curving surface curves toward the arcuately shaped front member; and the upper portion curves away from an upper section of the rear facing side of the arcuately shaped front member.

5. The removable tag of claim 4, wherein the series of protruding ridges are disposed along the middle portion of the curving surface closest to the rear facing side of the arcuately shaped front member.

6. The removable tag of claim 4, the direction of curvature of the curving surface is a first direction of curvature, wherein the curving surface further comprises a second direction curvature corresponding with and parallel to the direction of curvature of the concave surface.

7. The removable tag of claim 1, wherein the open channel area comprises a height defined between the bottom edge and the gripping element of approximately one (1) inch to one-half (1.5) inches.

8. The removable tag of claim 1, wherein the forward facing side of the arcuately shaped front member comprises a non-permanent writing surface.

9. A removable tag for a textile, comprising:

an arcuately shaped front member having a forward facing side and a rear facing side, wherein:

the arcuately shaped front member extends vertically upwards from a bottom edge to form a substantially flat surface in the vertical direction;

a first side edge and a second side edge of the arcuately shaped front member extend rearward to form a concave surface relative to the rear facing side, and the bottom edge curves rearward along a same arc path formed by the concave surface;

a rear member extending upwards from the bottom edge of the arcuately shaped front member adjacent the rear facing side, wherein:

the rear member comprises an elongate gripping element outwardly extending from a surface of the rear member toward the rear facing side of the front member and oriented parallel to the direction of curvature of the concave surface, wherein the first side edge and the second side edge of the arcuately shaped front member extend rearward of the elongate gripping element; and an open channel area is formed below the gripping element and above the bottom edge between a lower portion of the rear facing side of the arcuately shaped front member, and a lower portion of the surface of the rear member facing the rear facing side.

10. The removable tag of claim 9, further comprises an elongate gripping element disposed along the rear facing side of the front member, oriented parallel to the direction of curvature of the concave surface, and positioned proximate the elongate gripping element of the rear member.

11. The removable tag of claim 9, wherein the rear member further comprises an upper portion disposed above the elongate gripping element.

12. The removable tag of claim 11, wherein the rear member comprises a curved shape relative to the arcuately shaped front member such that the surface facing the rear facing side of the arcuately shaped front member forms a curving surface, wherein:

a direction of curvature of the curving surface is perpendicular to the direction of curvature of the concave surface;

a middle portion of the curving surface curves toward the arcuately shaped front member; and the upper portion curves away from an upper section of the rear facing side of the arcuately shaped front member.

13. The removable tag of claim 12, wherein the elongate gripping element comprises a series of ridges disposed along the middle portion of the curving surface closest to and facing the rear facing side of the arcuately shaped front member.

14. The removable tag of claim 13, wherein the ridges are aligned parallel to the direction of curvature of the concave surface.

15. The removable tag of claim 9, wherein the elongate gripping element is disposed at the uppermost portion of the rear member.

16. The removable tag of claim 15, wherein the elongate gripping element comprises a series of ridges extending further outwardly towards the rear facing side of the front member.

17. The removable tag of claim 15, wherein the elongate gripping element further comprises a portion extending into the open channel area.

18. The removable tag of claim 15, wherein the rear member comprises a curved shape relative to the arcuately shaped front member such that the surface of the rear member forms a curving surface, wherein a direction of curvature of the curving surface corresponds with and is parallel to the direction of curvature of the concave surface.

19. The removable tag of claim 9, further comprising a decorative element permanently affixed or removably attached to the forward facing surface of the front member.

20. The removable tag of claim 9, further comprising a ring formed in a lower surface adjacent the bottom edge configured for the connection of a hanging decoration.

* * * * *